US006332905B1

(12) United States Patent
Ootaguchi et al.

(10) Patent No.: US 6,332,905 B1
(45) Date of Patent: Dec. 25, 2001

(54) HIGH-STRENGTH METAL SOLIDIFIED MATERIAL AND ACID STEEL AND MANUFACTURING METHODS THEREOF

(75) Inventors: Minoru Ootaguchi; Shuji Wanikawa; Yuji Muramatsu; Kaneaki Tsuzaki; Kotobu Nagai; Toru Hayashi, all of Ibaraki (JP)

(73) Assignees: Japan as represented by Director General of National Research Institute for Metals, Ibaraki; Kawasaki Steel Corporation, Hyogo, both of (JP)

( * ) Notice: Subject to any disclaimer, the term of this patent is extended or adjusted under 35 U.S.C. 154(b) by 0 days.

(21) Appl. No.: 09/647,100

(22) PCT Filed: Mar. 26, 1999

(86) PCT No.: PCT/JP99/01566

§ 371 Date: Dec. 4, 2000

§ 102(e) Date: Dec. 4, 2000

(87) PCT Pub. No.: WO99/50009

PCT Pub. Date: Oct. 7, 1999

(30) Foreign Application Priority Data

Mar. 26, 1998 (JP) ..... 10-079978
Jul. 27, 1998 (JP) ..... 10-211657

(51) Int. Cl.[7] ..... C22C 33/02

(52) U.S. Cl. ..... 75/245; 75/246; 419/32; 419/42; 419/48

(58) Field of Search ..... 75/245, 246; 419/32, 419/42, 48, 62, 68

(56) References Cited

U.S. PATENT DOCUMENTS 5,006,164 * 4/1991 Kiyota ..... 75/255

* cited by examiner

*Primary Examiner*—Ngoclan Mai
(74) *Attorney, Agent, or Firm*—Wenderoth, Lind & Ponack, L.L.P.

(57) ABSTRACT

The invention according to the present application provides a high strength solidification body by solidifying a starting metallic powder of iron and the like by means of plastic working using hydrostatic pressing, which is, for instance, a high strength high toughness steel material and the like having a superfine texture comprising a crystalline texture consisting of grains 5 $\mu$m or less in average diameter, or preferably, 3 $\mu$m or less in average diameter. Furthermore, the present invention provides a steel material included in the high strength solidification body, which contains oxide grain 0.2 $\mu$m or less in diameter at a volume ratio of from 0.5 to 60%.

29 Claims, 3 Drawing Sheets

HIGH-STRENGTH METAL SOLIDIFIED MATERIAL AND ACID STEEL AND MANUFACTURING METHODS THEREOF

This is a 371 application of PCT/JP99/01566 filed Mar. 26, 1999.

TECHNICAL FIELD OF THE INVENTION

The present invention relates to a high strength metallic solidification body, oxygen steel, and a method for producing the same. In further detail, it relates to an easily producible high strength metallic solidification body of a metallic powder having an extremely high strength and elongation, to oxygen steel as a particular type of the high strength metallic solidification body, which is free of additional elements, and which is a light-weight highly rigid steel, and to a method for producing the same by using plastic working.

BACKGROUND OF THE INVENTION

Conventionally, in case of producing metallic materials by solidification molding of powders, mechanical alloying using ball mills was applied to obtain a powder having a sufficiently finely divided texture to thereby increase the strength of the resulting solidified product, and, furthermore, HIP processing was used to eliminate the pores therefrom. Thus, not only a conventional production method for obtaining a solidified body from a metallic powder required a large production system and a consumption of a vast production time and cost because many process steps were involved, but also it have a great difficulty in supplying a great amount of material at a time to carry out the batch process.

Although mass production is feasible if mechanical alloying and HIP processes are omitted, on the other hand, the resulting material have not only an insufficient strength because of a coarse texture, but also insufficient elongation and rigidity owing to the formation of large amount of coarse pores inside it.

Accordingly, mechanical alloying process and the HIP process subsequent thereto were regarded as indispensable means in the production of a solidification body of metallic powders. Hence, it had been thought difficult to realize a powder solidification body having a higher strength and still yet improved in elongation.

Moreover, in a steel material, regardless of whether it is a solidification body of a metallic powder or not, a high strength material having a TS of 590 MPa or higher had been produced by properly incorporating an additional element such as C, Si, Mn, Nb, Cu, Ni, etc., at a quantity of 0.22 mass % or more in Pcm, and then by applying quenching and tempering, or employing controlled rolling or controlled cooling. However, the steel materials obtained in this manner required the addition of various types of rare elements, and, hence, the resulting materials suffered problems as such that they were not suitable for recycled use, or required preheating in case of applying welding, or caused hardening at the portions which were thermally influenced during welding. Moreover, because it was difficult to obtain a uniform texture for the entire cross section, heterogeneous material distribution was found in the steel material.

SUMMARY OF THE INVENTION

Accordingly, in re-examining the conventional technological knowledge and common beliefs, a first object of the invention according to the present application is to provide a high strength metallic solidification body having, for instance, a strength of 450 MPa or higher and a uniform elongation of 5% or more, which is capable of being produced by mass production but without employing the mechanical alloying process and the subsequent HIP process.

The above object can be accomplished by one aspect of the invention according to the present application, which provides a high strength metallic solidification body which is characterized by being a solidification body of a starting metallic powder containing iron or titanium as the principal component and having a super fine texture comprising a crystalline texture consisting of grains 5 $\mu$m or less in average grain diameter.

In accordance with another aspect of the invention according to the present application, there is provided a high strength metallic solidification body in relation to above, which is solidified by plastic working using hydrostatic pressing, and particularly, by plastic working using at least one selected from flat rolls, grooved rolls, extrusion, and swaging, or a high strength metallic solidification body subjected to plastic working using a sheath material; or a high strength metallic solidification body solidified at a temperature not higher than 800° C.

A second object of the invention according to the present application is to provide a novel steel material almost free of additional elements such as Si, Mn, Nb, Cu, and Ni, and which exhibits, for example, a strength of 590 MPa or higher, a uniform elongation of 5% or more, and superior rigidity, yet having excellent weldability by overcoming the problems of the preheating treatment and the hardening of thermally influenced portions, and also superb properties suitable for recycled use.

As a solution to the object above, the invention according to the present application provides an oxygen steel which is a steel material in which oxide grains 0.2 $\mu$m or less in diameter is dispersed for 0.5 to 60 % by volume.

Furthermore, the invention according to the present application provides the oxygen steel above, wherein the ferritic grains comprising the matrix phase are 5 $\mu$m or less in average diameter; or an oxygen steel according to any of the aforementioned ones, having an oxygen content of 0.05 mass % or more, and furthermore, an oxygen steel according to any of the aforementioned ones, wherein the value of tensile strength (MPa) multiplied by uniform elongation (%) is 4,000 (MPa·%) or greater, and the reduction of area is 50% or higher.

In addition to above, the invention according to the present application provides a method for producing the high strength metallic solidification body and the oxygen steel above.

More specifically, the invention according to the present application provides a method for producing a high strength metallic solidification body which comprises solidifying a starting metallic powder containing iron or titanium as the principal component by means of plastic working using hydrostatic pressing, thereby producing a metallic solidification body having a superfine texture comprising crystalline texture consisting of grains 5 $\mu$m or less in average diameter.

Further, the invention provides a production method in relation to above, wherein the plastic working comprises at least one of those using flat rolls, grooved rolls, extrusion, and swaging, or a production method comprising plastic working using a sheath material; in which the plastic working may be performed at a temperature not higher than 800° C.

Furthermore, the invention provides, in addition to the production method comprising milling a metallic powder and then solidifying the powder by applying plastic working while maintaining it in a sealed state, a method for producing a steel material comprising using a starting powder containing iron as the principal component, wherein the starting powder contains 0.05 mass % or more of oxygen and applying the plastic working in a temperature range of from 500° C. to the transformation temperature of iron, thereby producing a steel material containing dispersed therein oxide grains 0.2 μm or less in average diameter at a volume ratio of from 0.5 to 60%.

The invention also provides a production method according to those described above, wherein the starting powder containing iron as the principal component comprises from 0.05 to 0.5 mass % of oxygen, 0.01 mass % or less of carbon, 0.1 mass % or less of chromium, 0.1 mass % or less of silicon, and 0.5 mass % or less of manganese.

DESCRIPTION OF THE PREFERRED EMBODIMENTS

Figure 1:
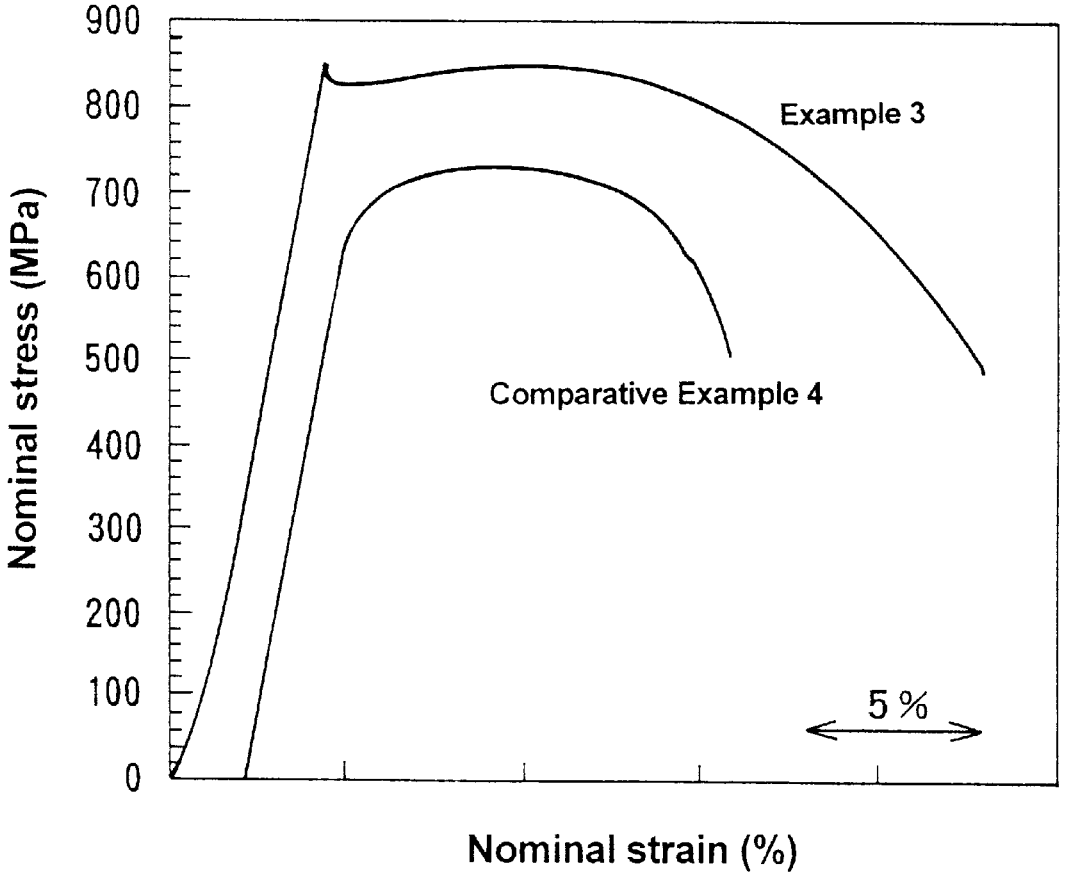
FIG. 1 is a diagram showing stress-strain curve.

Although the characteristics of the present invention are briefly described above, the embodiment of the present invention is described below.

The high strength metallic solidification body according to the present invention has two requirements as follows. <1>The solidification body comprises a starting metallic powder containing iron (Fe) or titanium (Ti) as the principal component. <2>The average grain diameter of the grains constituting the crystalline texture is 5 μm or less, and more preferably, 3 μm or less.

By satisfying the requirements above, the present invention provides a high strength metallic solidification body having a strength of 450 MPa or higher and a uniform elongation of 5% or more.

Concerning the starting metallic powder containing iron or titanium as the principal components there may be used a powder of various types of materials such as a metal, an alloy, or an intermetallic compound, which contains 50% by atomic or more, more favorably, 80% or more, of iron (Fe) or titanium (Ti). The powder need to be of high purity, and those produced by an ordinary process, such as an atomization process or KIP process (a process of producing powder comprising reducing the surface scales of steel) are usable. The average diameter of the powder is 100 μm or less, and more preferably, 30 μm or less. A case in which the average diameter of the powder is too large as to exceed 100 μm is not preferred because the crystal grains constituting the powder becomes too coarse.

The crystalline texture of the solidification body comprises, as described above, grains having an average diameter of 5 μm or less, and more preferably, 3 μm or less. This is because, if the grain diameter becomes larger than 5 μm, the effect of sufficiently increasing the strength resulting from the fine texture cannot be expected.

The high strength metallic solidification body according to the present invention is characterized in that it can be produced completely free of the mechanical alloying and the subsequent HIP process which were conventionally thought to be essential means. That is, the high strength metallic solidification body according to the present invention is realized without using mechanical alloying or HIP process.

The means of solidification, i.e., the production method for the metallic solidification body is explained below. In the present invention, plastic working using hydrostatic pressing is favorably employed. More specifically, for the plastic working, one type or more selected from flat rolls, grooved rolls, extrusion, and swaging can be used.

The reason why it is preferred to use flat rolls for the solidification molding, grooved rolls, extrusion, or swaging is that the pressing using hydrostatic pressure suppresses the abnormal grain growth in the texture in to obtaining a fine texture. Furthermore, by using flat rolls, grooved rolls, extrusion, or swaging, the pores inside the material can be suppressed to a level that do not influence the strength or elongation. These solidification molding methods are advantageous in mass production because they can be performed online (in an automated process).

Preferably, the solidification molding is performed at a temperature not higher than 800° C. Generally, the plastic working using the hydrostatic pressure above at the temperature is preferably performed at a reduction in area of 70% or more, and more preferably, 80% or more.

The temperature for solidification is set at 800° C. or lower, because if solidification is performed at a temperature higher than 800° C., the texture becomes coarse due to abnormal growth of the grains, and brings about a drop in strength.

It is preferred to use a sheath material in the solidification. The sheath material is preferably a tubular material, i.e., in the shape of a pipe, tube, etc. The sheath material is effective for sealing and fixing the starting metallic powder inside the tube, then for facilitating the application of a hydrostatic pressure during the solidification molding, for suppressing the abnormal grain growth in the texture, and etc. For the application of a hydrostatic pressure during solidification molding, It is preferable that the wall thickness of the sheath with respect to the diameter of the powder grains is 1/10 or more. There is no particular restriction concerning the material for use as the sheath. For instance, various types of materials such as JIS SS400 steel, JIS SM490 steel, JIS S45C steel, etc., are applicable.

The starting metallic powder may be subjected to milling treatment prior to the solidification operation by means of plastic working under hydrostatic pressure. For example, applicable are planetary ball milling (at room temperature and for a duration of 10 hours or longer) and rotary ball milling (at room temperature and for a duration of 50 hours or longer) in an inert gas atmosphere. As an example of a high strength metallic solidification body above, it is possible to produce a novel steel material.

For instance, there can be mentioned an oxygen steel provided by the present invention as described above.

The steel material comprises dispersed therein oxide grains 0.2 μm or less in diameter accounting for 0.5 to 60% by volume. The oxide grains in this case have the effect of developing a fine texture in the matrix of the steel, and the effect is greater with decreasing diameter of the oxide grains, but the effect of suppressing the growth of crystal grains is small in case the diameter exceeds 0.2 μm. Furthermore, unless the oxide accounts for 0.5% by volume or more in the steel texture, the effect of finely dividing the texture of the matrix becomes small. On the contrary, on the other hand, the ductility and the toughness of the steel are impaired if the oxide accounts for 60% or more by volume in the steel texture.

Thus, in the steel according to the present invention, the oxide grains to be dispersed should be 0.2 μm or less in diameter, and the dispersed oxide should account for 0.5 to 60% by volume of the entire steel.

In dispersing oxide, it is preferred that, from the viewpoint of the properties of the steel, the matrix of the steel exhibits a ferritic texture, and that the ferrite grains have an average diameter of 5 μm or less.

In the oxygen steel according to the present invention described above, it is not necessary to excessively incorporate an additional element such as C, Si, Mn, Nb, Cu, Ni, etc., as in the conventional cases, and, even more, some of the conventionally added elements may be completely omitted. As the oxygen steel according to the present invention, for instance, a high strength steel having a strength of 590 MPa and a uniform elongation of 5% or more is available.

Thus dispersed oxide yields a melting point higher than nitrides or carbides. Hence, a part of the oxide remains without being molten at the portions thermally influenced by welding, and exhibits an effect of preventing coarsening of the texture of the matrix at the thermally influenced portions. Thus, the portions thermally influenced by welding also exhibit excellent toughness. Oxygen must be present at a quantity of 0.05 mass % or more to sufficiently yield oxide precipitates.

The stiffness of the steel increases and the density decreases with increasing volume ratio of the oxide. Thus, a further lightweight high strength steel can be provided by increasing the volume ratio of the oxides.

In general, the tensile strength and the uniform elongation are conflicting properties; that is, an increase in tensile strength lowers the uniform elongation.

However, the steel according to the present invention is characterized in that the uniform elongation increases with strength. As described above, the steel according to the present invention is particularly distinguished by having a value of tensile strength (MPa) multiplied by uniform elongation (%) of 4,000 (MPa·%) or higher, while yielding a reduction in area of 50% or higher.

The oxide grains that are dispersed in the steel texture can be precipitated at the time of production.

In view of the conventionally employed composition of the starting material, elements other than the principal component of steel, i.e., Fe (iron), are to be added in small quantity as the need arise. The elements make into alloy need not be added. For instance, the composition of the steel according to the present invention comprises, by mass (%), 0.5 or less of O (oxygen), 0.01 or less of C (carbon), 0.1 or less of Cr (chromium), 0.1 or less of Si (silicon), and 0.5 or less of Mn (manganese); and more specifically, there can be exemplified a composition expressed by (in mass %): O: 0.2, C: 0.002, Cr: 0.05, Si: 0.02, and Mn: 0.16.

The starting powder containing iron as the principal component may be prepared by various types of methods, and mentioned are those prepared by, for instance, atomization process and KIP process (a process of producing powder comprising reducing the surface scales of steel).

The oxides that are subjected to precipitation dispersion are, for example, an iron oxide, a Ti oxide, a Cr oxide, and a Si oxide.

A representative production method for use in the oxide dispersed steel according to the present invention can be exemplified as follows.

Firstly, the starting iron powder with the composition above is subjected to milling for a duration of 10 to 20 hours (at room temperature and under argon atmosphere) using a planetary ball mill and the like. Then, the milled starting iron powder is sealed air-tight in a canister, and then subjected to rolling using grooved rolls to a reduction in area of 80% or higher in the temperature range of from 500 to 800° C., preferably, for example, at 700° C. (and holding at the temperature for 1.5 hours).

As a matter of course, the production method according to the present invention is not limited to the representative example above. In the present invention, a steel material may be produced by first subjecting a starting metallic powder containing iron as the principal component to milling, and then solidifying the resulting powder by plastic working applying hydrostatic pressure, thereby obtaining a steel material containing dispersed therein from 0.5 to 60% by volume of oxides 0.2 μm or less in diameter. The plastic working in this case can be carried out by using at least one selected from flat rolls, grooved rolls, extrusion, and swaging, but preferred among them is working using grooved rolls.

Preferably, the starting metallic powder contains 0.05 mass % or more of oxygen, and for the precipitation dispersion of oxides, it is preferred to apply plastic working in the temperature range of from 500° C. to the transformation temperature of iron.

Various types of methods are applicable in controlling the oxygen content to 0.05 mass % or more, but in controlling the oxygen content to a preferred range of from 0.05 to 0.5 mass %, for instance, the starting powder may be subjected to reduction treatment to reduce the oxygen content to the predetermined range. As a reduction treatment for use in this case, there may be mentioned annealing in hydrogen, in which the final oxygen content is controlled by the time duration and temperature of annealing.

For the milling to be performed prior to the plastic working under hydrostatic pressure, means such as rotary ball mill, planetary ball mill, etc. is used. In the present invention, in general, a proper treatment is performed at room temperature and for a duration of 50 hours or longer in case of using a rotary ball mill, and for 10 hours or longer in case of using a planetary ball mill.

The present invention is described in further detail by referring to Examples below.

EXAMPLES

Example 1

A KIP iron powder having a chemical composition by mass % of 0.002 C, 0.16 Mn, 0.2 O, and balance Fe was processed under conditions shown in Table 1 to finally obtain a rod-like test specimen 12-mm square by 800-mm length. More specifically, a KIP iron powder, without applying ball milling and HIPping, was sealed inside a tube for a sheath material of 40 mm in outer diameter, 30 mm in inner diameter and 150 mm in length, made of a steel material (S45C) having a Vicker's hardness of 223 and a wall thickness of 5 mm. Then, the sealed product was subjected to plastic working for solidification at 700° C. under hydrostatic pressure using a grooved roll (wherein, the grooved roll used herein was such having a shape of 40-mm square to 14.3-mm square) to thereby obtain a rod-like test specimen. A test specimen 4 mm in diameter and 16 mm in length for use in tensile test was produced from the parallel portion of the resulting test specimen, and was subjected to tensile test. The results are given in Table 1. Although no ball milling and HIPping were applied, the solidification products according to the Example of the present invention yielded a tensile strength (TS) of 450 MPa or higher and a uniform elongation of 5% or more.

The average diameter of the grains constituting the crystalline texture was found to be as fine as 2.8 μm.

Example 2

A grooved roll processing was performed in the same manner as in Example 1, except for subjecting the KIP iron powder to ball milling for a duration of 30 hours to the processing.

Referring to Table 1, the solidification product thus obtained yielded a strength of 600 MPa and a uniform elongation of 5% although no HIPping was applied thereto. Furthermore, The average diameter of the grains constituting the crystalline texture was found to be as fine as 2.0 μm.

Comparative Example 1

The same KIP iron powder as in Example 1 was subjected to ball milling treatment for a duration of 200 hours, and was then HIPped. As is shown in Table 1, substantially no uniform elongation was observed on the test specimen thus obtained.

The average diameter of the grains constituting the crystalline texture was considerably large.

Comparative Example 2

The same KIP iron powder as in Example 1 was subjected to HIPping at 700° C. for a duration of 1 hour, and was subjected to grooved roll processing in the same manner as in Examples 1 and 2.

Referring to Table 1, the average diameter of the grains constituting the crystalline texture of the thus obtained solidification product was as large as 5.5 μm, and the strength was as low as to yield 396 MPa.

Comparative Example 3

The same procedure of Comparative Example 2 was conducted, except for not performing the grooved roll processing. The average diameter of the grains constituting the crystalline texture was 23 μm, and the strength was extremely low as to yield 360 MPa.

TABLE 1

| Test | Ball Milling | HIP | Grooved rolls | Nominal grain diameter (μm) | TS (MPa) | Uniform Elongation (%) |
|---|---|---|---|---|---|---|
| Ex. 1 | None | None | 700° C., 85% | 2.8 | 470 | 8 |
| Ex. 2 | 30 hr | None | 700° C., 85% | 2.0 | 600 | 5 |
| Comp. Ex. 1 | 200 hr | 700° C. 1 hr | None | Not available | 910 | 0 |
| Comp. Ex. 2 | None | 700° C. 1 hr | 700° C., 85% | 5.5 | 396 | 8 |
| Comp. Ex. 3 | None | 700° C. 1 hr | None | 23 | 360 | 15 |

It can be seen from Table 1 that, the invention according to the present application is capable of providing a high strength and high toughness material having a texture consisting entirely of grains with average diameter of 5 μm or less, and furthermore, 3 μm or less, although mechanical alloying using ball milling and the subsequent HIP process, i.e., the processes conventionally thought to be essential in the production, were omitted. Thus, it can be seen that a fine crystalline texture is available without performing the conventionally employed excessive addition of elements; hence, the present invention is useful in conserving resources and energy.

Example 3

A KIP iron powder having a chemical composition by mass % of 0.002 C, 0.16 Mn, 0.2 O, and balance Fe was subjected to planetary milling for a duration of 20 hours, and was filled inside a S45C tubular material having an outer diameter of 40 mm and an inner diameter of 30 mm, which was then vacuum canned at 480° C. for a duration of 15 hours. The resulting product was then cooled in the furnace. Then, the product was reheated to 700° C., was held at the temperature for 1.5 hours, and was subjected to the reduction of area using grooved rolls at a reduction ratio of 89%.

In Table 2 are given the results obtained by tensile test. It can be seen that the product, although the addition of the alloy elements was very small, yields a strength higher than that obtained in Comparative Example and an excellent uniform elongation of 7%.

Comparative Example 4

A steel containing by mass %, 0.055 C, 0.25 Si, 1.5 Mn, 0.010 Nb, 0.10 Ni, 0.10 Cu, and balance Fe was held at 1,100° C. for a duration of 600 seconds, then at 300° C. for a duration of 1,200 seconds, and was cooled in air to obtain a bainitic steel. The comparative sample thus obtained was subjected to tensile test, the results of which are also given in Table 2.

TABLE 2

| Test | Example 3 | Comparative Example 4 |
|---|---|---|
| Tesile Strength (MPa) | 850 | 731 |
| Uniform Elongation (%) | 7 | 4 |
| Total Elongation (%) | 20 | 12 |
| Reduction of Area (%) | 74 | — |
| Diameter of Oxides (mm) | 30 | — |
| Volume Ratio (%) | 1 | About the amount equivalent to that of unavoidable impurities |
| Diameter of Ferritic Grains in the Matrix (μm) | 0.4 | — |
| Oxygen Content (%) | 0.2 | About the amount equivalent to that of unavoidable impurities |

In FIG. 1 are shown the stress-strain curves for each of the steel materials obtained in Example 3 and in Comparative Example 4.

Concerning the value of tensile strength (MPa) multiplied by uniform elongation (%), the product obtained in Example 3 yields 5,920 (MPa·%), whereas that obtained in Comparative Example 4 gives 2,924 (MPa·%).

It can be seen that the steel material obtained in Example 3 yields a tensile strength higher by 120 MPa and a uniform elongation greater than those obtained in Comparative Example 4. That is, it is clearly shown that the steel material obtained in Example 3 is superior in the tensile strength-uniform elongation balance to that obtained in comparative Example 4.

Figure 2:
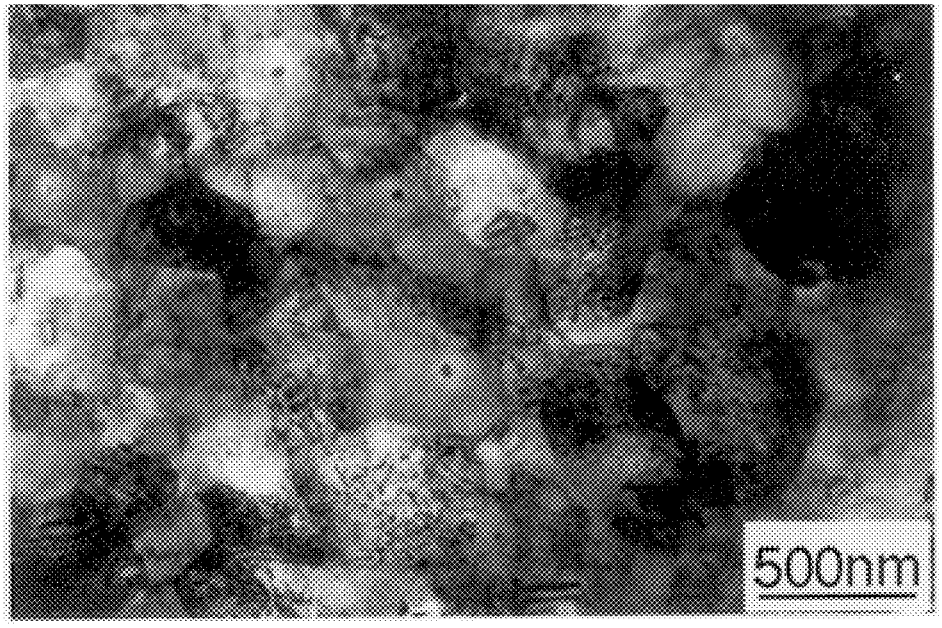
FIG. 2 is a diagram showing the metallic texture observed under a transmission electron microscope (TEM)

FIG. 2 shows a TEM photograph of the steel material obtained in Example 3. It was confirmed that the material obtained by applying planetary milling for 20 hours contains the oxide uniformly and finely dispersed therein. Furthermore, the ferritic grains of the matrix are as fine as to yield a diameter of about 0.5 μm. This texture was present uniformly over the final product having a diameter of 10 mm.

Figure 3:
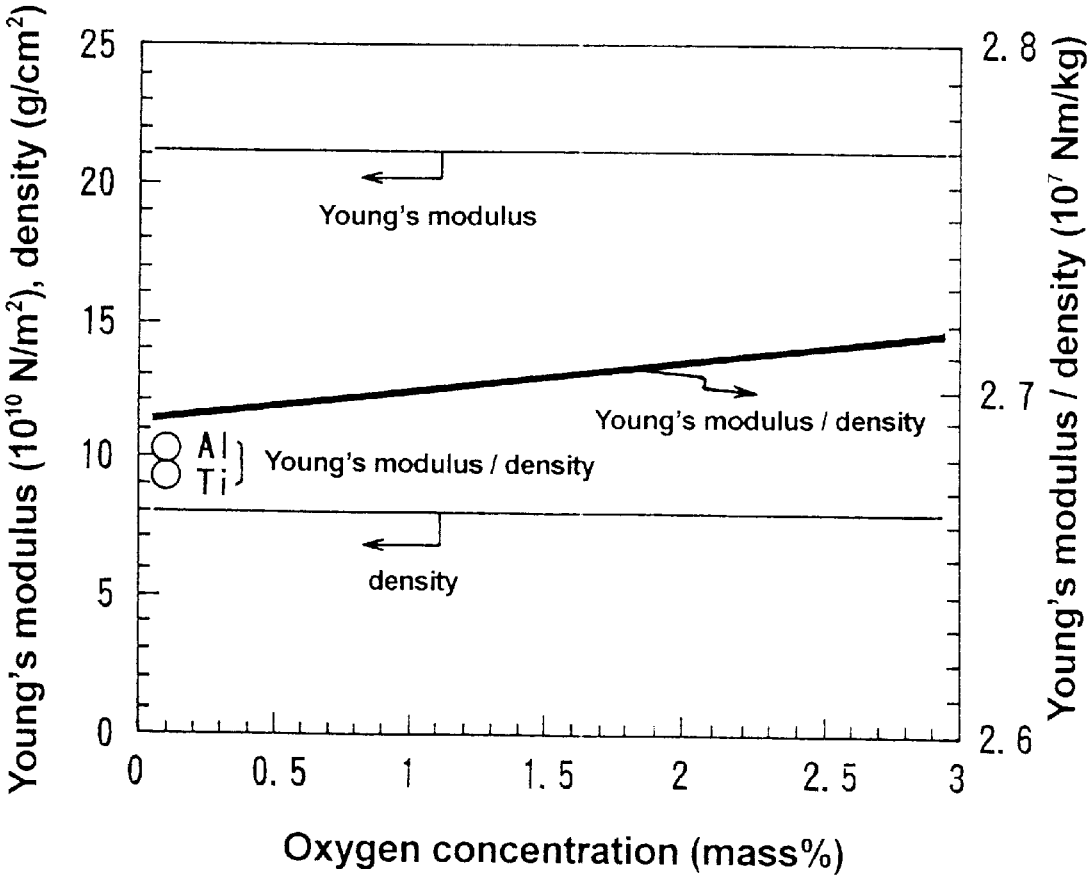
FIG. 3 is a diagram showing the changes of Young's modulus, density, and the ratio of Young's modulus to density with respect to oxygen concentration.

FIG. 3 shows the changes in modulus of rigidity, average density, and the ratio of the modulus of rigidity to density ([modulus of rigidity]/[density]ratio) with respect to oxygen concentration.

It can be seen that the Young's modulus slightly increases while the density decreases with increasing oxygen concentration. Accordingly, the [Young's modulus]/ [density]ratio increases with increasing oxygen concentration, where the [Young's modulus]/ [density]ratio represents the relative modulus of rigidity. This signifies that the material is lighter and higher in rigidity with increasing value of this ratio, and that the material is resistant to deflection. Accordingly, the present invention is capable of providing a steel material that is lightweight and resistant to deflection. In FIG. 3 is also given the data of [Young's modulus]/ [density]ratio for A1 and Ti. It can be seen that the oxygen steel according to the present invention is superior to A1 and Ti.

Thus, it has been confirmed that the present invention provides, without substantially adding the conventional alloying elements, a high strength steel material having excellent toughness, yet having superior weldability free from the problems of preheating treatment and the hardening of the thermally influenced portions.

Since the steel material according to the present invention is almost free of additional alloying elements, it saves resources, is reduced in the production cost, and is suitable for recycled use.

Furthermore, the present invention provides a lighter high strength steel.

APPLICABILITY IN THE INDUSTRY

The metallic solidification body of the invention according to the present application is provided as a high strenth metallic solidification body having a strength of 450 MPa or higher and a uniform elongation of 5% or more, without employing mechanical alloying and HIPping subsequent thereto.

Furthermore, a high strength steel material having excellent toughness and weldability is provided without substantially adding an alloy element.

What is claimed is:

1. A high strength metallic solidification body which is characterized by being a solidification body of a starting metallic powder containing iron or titanium as the principal component and having a super fine texture comprising a crystalline texture consisting of grains 5 μm or less in average grain diameter.

2. A high strength metallic solidification body as claimed in claim 1, which is solidified by plastic working using hydrostatic pressing.

3. A high strength metallic solidification body as claimed in claim 2, wherein the plastic working comprises at least one of those using flat rolls, grooved rolls, extrusion, and swaging.

4. A high strength metallic solidification body as claimed in claim 2, wherein the plastic working is performed by using a sheath material.

5. A high strength metallic solidification body as claimed in claim 2, which is solidified at a temperature not higher than 800° C.

6. An oxygen steel which is a steel material in which oxide grains 0.2 μm or less in diameter is dispersed 0.5 to 60% by volume.

7. An oxygen steel as claimed in claim 6, wherein the ferritic grains comprising the matrix phase are 5 μm or less in average diameter.

8. An oxygen steel as claimed in claim 6, wherein the oxygen content is 0.05 mass % or more.

9. An oxygen steel as claimed in claim 6, wherein the value of tensile strength (MPa) multiplied by uniform elongation (%) is 4,000 (MPa·%) or greater, and the reduction of area is 50% or higher.

10. A production method for a high strength metallic solidification body, which comprises solidifying a starting metallic powder containing iron or titanium as the principal component by means of plastic working using hydrostatic pressing, thereby producing a metallic solidification body having a superfine texture comprising crystalline texture consisting of grains 5 μm or less in average diameter.

11. A production method as claimed in claim 10, wherein the plastic working comprises at least one of those using flat rolls, grooved rolls, extrusion, and swaging.

12. A production method as claimed in claim 10, wherein the plastic working comprises using a sheath material.

13. A production method as claimed in claim 10, wherein the plastic working is performed at a temperature not higher than 800° C.

14. A production method as claimed in claim 10, wherein the starting metallic powder is subjected to milling, and then to plastic working for solidification.

15. A production method as claimed in claim 14, wherein the starting powder is a metallic powder containing iron as the principal component.

16. A production method as claimed in claim 15, wherein the starting powder contains 0.05 mass % or more of oxygen, and in which the plastic working is applied in a temperature range of from 500° C. to the transformation temperature of iron, thereby producing a steel material inwhich oxide grains 0.2 μm or less in average diameter is dispersed at a volume ratio of from 0.5 to 60%.

17. A production method as claimed in claim 16, wherein the starting powder containing iron as the principal component further contains from 0.05 to 0.5 mass % of oxygen, 0.01 mass % or less of carbon, 0.1 mass % or less of chromium, 0.1 mass % or less of silicon, and 0.5 mass % or less of manganese.

18. A high strength metallic solidification body as claimed in claim 3, wherein the plastic working is performed by using a sheath material.

19. A high strength metallic solidification body as claimed in claim 3, which is solidified at a temperature not higher than 800° C.

20. A high strength metallic solidification body as claimed in claim 4, which is solidified at a temperature not higher than 800° C.

21. An oxygen steel as claimed in claim 7, wherein the oxygen content is 0.05 mass % or more.

22. An oxygen steel as claimed in claim 7, wherein the value of tensile strength (MPa) multiplied by uniform elongation (%) is 4,000 (MPa·%) or greater, and the reduction of area is 50% or higher.

23. An oxygen steel as claimed in claim 8, wherein the value of tensile strength (MPa) multiplied by uniform elongation (%) is 4,000 (MPa·%) or greater, and the reduction of area is 50% or higher.

24. A production method as claimed in claim 11, wherein the plastic working comprises using a sheath material.

25. A production method as claimed in claim 11, wherein the plastic working is performed at a temperature not higher than 800° C.

26. A production method as claimed in claim 12, wherein the plastic working is performed at a temperature not higher than 800° C.

27. A production method as claimed in claim 11, wherein the starting metallic powder is subjected to milling, and then to plastic working for solidification.

28. A production method as claimed in claim 12, wherein the starting metallic powder is subjected to milling, and then to plastic working for solidification.

29. A production method as claimed in claim 13, wherein the starting metallic powder is subjected to milling, and then to plastic working for solidification.

* * * * *